US011053700B2

(12) United States Patent
van den Bosch et al.

(10) Patent No.: US 11,053,700 B2
(45) Date of Patent: Jul. 6, 2021

(54) FOLDABLE COVER FOR A SWIMMING POOL

(71) Applicant: Dutch Toys Group Holding B.V., Doetinchem (NL)

(72) Inventors: Jeroen van den Bosch, Doetinchem (NL); Hendrik Marinus Jacobs, Doetinchem (NL); Stijn Gerard Driever, Doetinchem (NL)

(73) Assignee: Dutch Toys Group Holding B.V., Doetinchem (NL)

( * ) Notice: Subject to any disclaimer, the term of this patent is extended or adjusted under 35 U.S.C. 154(b) by 0 days.

(21) Appl. No.: 16/752,713

(22) Filed: Jan. 27, 2020

(65) Prior Publication Data

US 2020/0240162 A1 Jul. 30, 2020

(30) Foreign Application Priority Data

Jan. 28, 2019 (NL) ..... 2022465

(51) Int. Cl.
*E04H 4/10* (2006.01)

(52) U.S. Cl.
CPC ..... *E04H 4/108* (2013.01)

(58) Field of Classification Search
CPC ..... E04H 4/108; E04H 4/10; E04H 4/088
USPC ..... 4/503
See application file for complete search history.

(56) References Cited

U.S. PATENT DOCUMENTS 4,163,295 A * 8/1979 Schutz ..... E04H 4/10 4/500
4,227,542 A * 10/1980 Bonfilio ..... E04H 4/108 135/132
5,004,001 A * 4/1991 Bouchard ..... E04H 4/108 135/133
6,272,695 B1 8/2001 Brandner
7,051,481 B2 * 5/2006 Delavega ..... E04H 6/04 135/133
8,397,440 B1 3/2013 Ceballos
2009/0121207 A1 5/2009 Bowerman

FOREIGN PATENT DOCUMENTS

CZ 16451 U1 6/2006
CZ 16451 U1 6/2006

OTHER PUBLICATIONS

Exit Toys, Exit pool wood 400 cm by 200 cm with dome, https://www.youtube.com/watch?v=eH-gkwm3P-s , Jul. 22, 2018, see particularly time codes 1:17 to 1:27.

* cited by examiner

*Primary Examiner* — Huyen D Le
(74) *Attorney, Agent, or Firm* — Oppedahl Patent Law Firm LLC

(57) ABSTRACT

The present invention relates to a foldable cover (1) for a swimming pool (100). The cover comprises a foldable cover material (2), a number of supports (3) extending over the cover material for folding and unfolding the cover material and two support units (10) to be arranged on opposite sides of the cover (1) for rotatable attachment of outer ends of a number of the supports (3) around first rotation axes. The support units comprise attaching means for attaching the support units to the swimming pool. The attaching means comprise suspension arms, which suspension arms are provided with first suspension means for releasably suspending the support unit (10) on a rail (101) of the swimming pool (100).

15 Claims, 5 Drawing Sheets

FOLDABLE COVER FOR A SWIMMING POOL

BACKGROUND

The present invention refers to a foldable cover for a swimming pool, wherein the cover comprises a foldable cover material, a number of supports extending over the cover material for folding and unfolding the cover material and two support units to be arranged on opposite sides of the cover for rotatable attachment of outer ends of a number of the supports around first rotation axes, wherein the support units comprise attaching means for attaching the support units to the pool.

A foldable cover according to the preamble is known per se in the art and is designed to protect a swimming pool from dirt as well as to provide shelter to users of the swimming pool against weather conditions, such as wind and ultraviolet radiation. Additionally the cover has a greenhouse effect and ensures that the water in the swimming pool is heated by the sun. The known cover can be easily put in a folded (open) position, an unfolded (closed) position or even a semi-folded position. The known cover is arranged for use with a specific type of swimming pool.

The invention has for its object to provide a foldable cover of the type stated in the preamble that is universal and can be attached to many swimming pools.

BRIEF DESCRIPTION

The foldable cover according to the present invention is thereto characterized in that the attaching means comprise suspension arms, which suspension arms are provided with first suspension means for releasably suspending the support unit on a rail of a pool.

Many swimming pools comprises a rail, more specifically a top rail, on which the foldable cover according to the present invention can be suspended. In the suspended position the support units are positioned below the rail and consequently the supports with cover material are positioned below the rail in the folded position, where they can conveniently remain. In the unfolded position the cover material stretches downwardly past the rail. When compared to the known cover a better shield from wind and rain is thus obtained and more dirt can be kept out.

In a first preferred embodiment of the foldable cover according to the present invention the suspension arms are rotatably connected to the support units. By rotating the suspension arms, the support units can be positioned closely to the swimming pool to obtain an optimal adaptation to the shape of the swimming pool.

In a practical elaboration of the first preferred embodiment the suspension arms are rotatably connected to the support units around second rotation axes that are oriented substantially transverse to the first rotation axes.

According to a universal preferred embodiment of the foldable cover according to the present invention the first suspension means comprise clamps, preferably U-shaped clamps. The size of the clamps can be chosen such that one size clamp fits the rails of many swimming pools.

In a robust preferred embodiment of the foldable cover according to the present invention each support unit is further provided with second suspension means for releasably attaching the support unit on a leg of a swimming pool. The second suspension means provide improved stability. In this robust preferred embodiment the cover is especially suitable for use with a frame pool, a specific type of swimming pool that comprises a top rail and a number of legs for connection to the top rail.

According to a universal elaboration of the robust preferred embodiment the second suspension means for releasably attaching the support unit on a leg of a swimming pool comprise clamps, preferably U-shaped clamps. The size of the clamps can be chosen such that one size clamp fits the legs of many swimming pools.

In a practical embodiment of the foldable cover according to the present invention one of the supports is to be attached fixedly at its outer ends to the support units and forms an end support. In the folded position all rotatable supports are laid down on the end support.

In an elegant embodiment of the foldable cover according to the present invention each support unit comprises a housing provided with a first and a second surface that are spaced apart, wherein the first rotation axes extend transverse through both the first and the second surface.

In a further elaboration of the elegant embodiment a third surface is connected to an upper edge of the first surface and is oriented substantially transverse to the first surface, wherein the suspension arms are connected to the third surface.

In a universal embodiment the foldable cover according to the present invention is generally dome shaped. A dome is a natural shape that fits a circular pool and most swimming pools are circular.

In a cost-efficient elaboration of the universal embodiment the supports are made of a flexible material and can be bowed to form arches. In a disassembled state the supports are advantageously straight and take up less space during transport and storage. Preferably the flexible material is fibre glass.

Preferably the cover material comprises PVC or PE. More preferably the cover material is transparent.

The invention also relates to an assembly of a foldable cover according to the invention and a frame pool, said frame pool comprising a top rail and a number of legs for connection to the top rail.

DESCRIPTION OF THE DRAWING

The invention will now be described in more detail with reference to the figures.

The same components are designated in the figures with the same reference numerals.

DETAILED DESCRIPTION

Figure 1A:
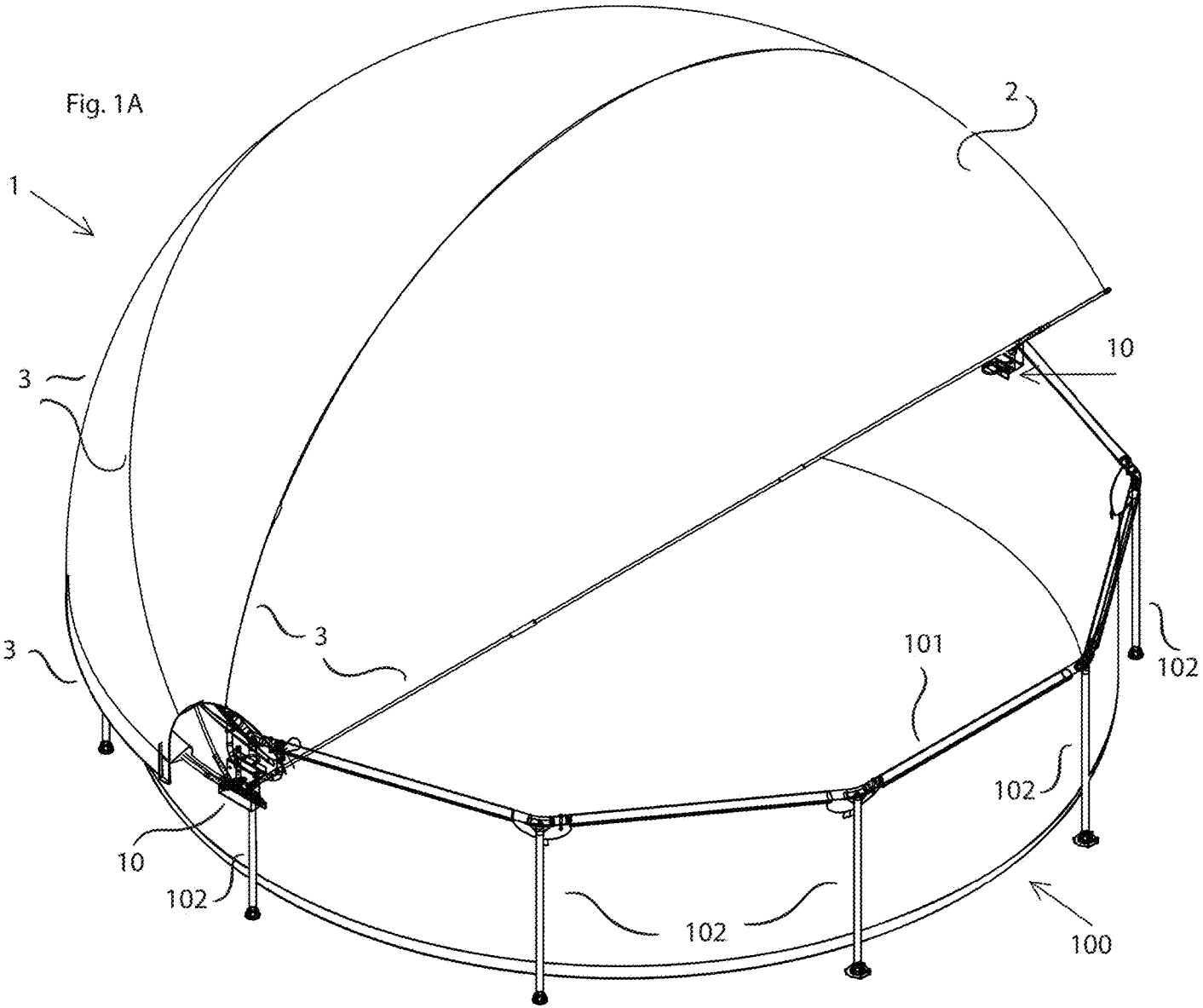
FIG. 1A shows schematically a preferred embodiment of a frame pool and a cover according to the present invention with the cover in a semi-folded position.
Figure 1B:
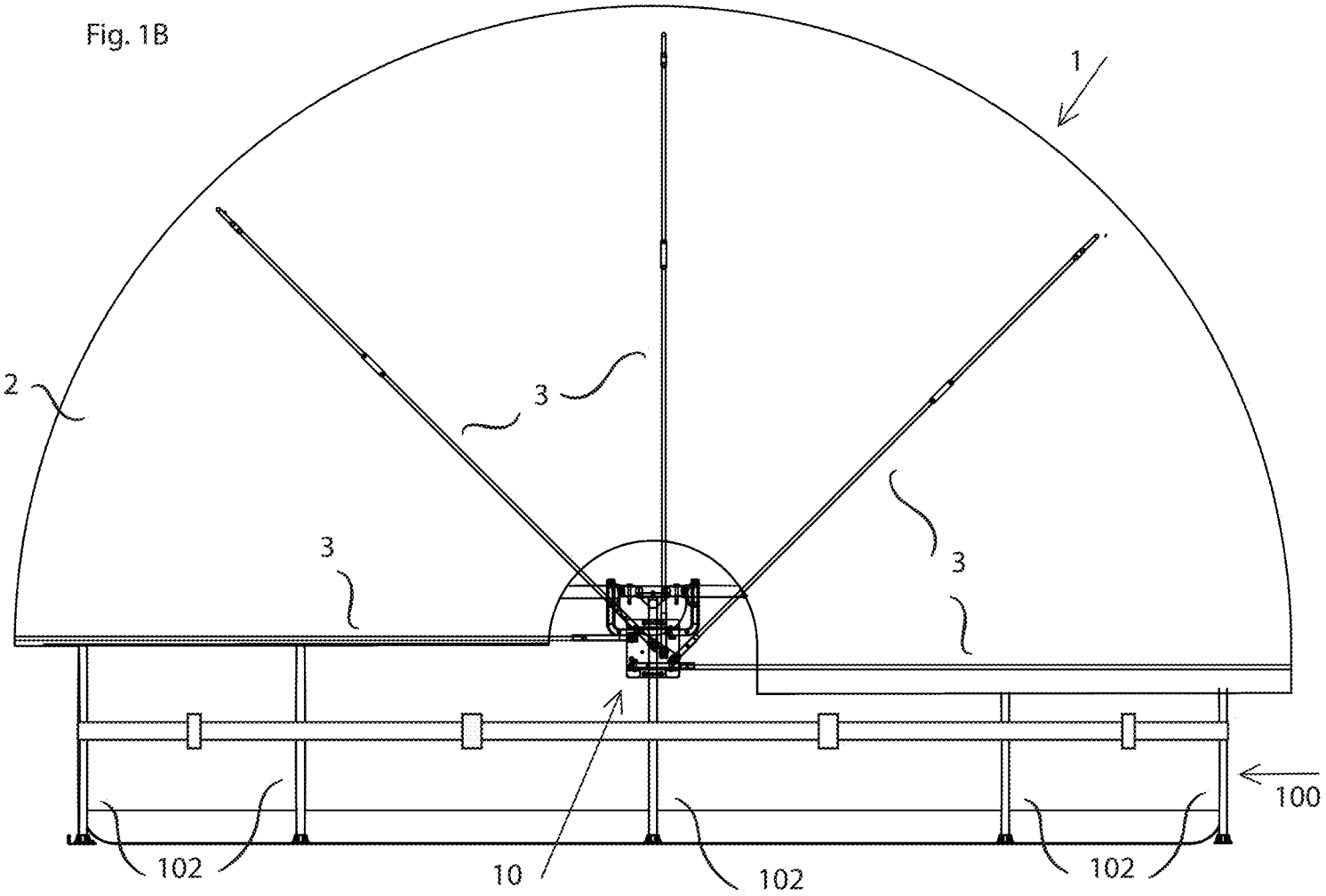
FIG. 1B shows schematically the preferred embodiment of FIG. 1A with the cover in an unfolded position.
Figure 1C:
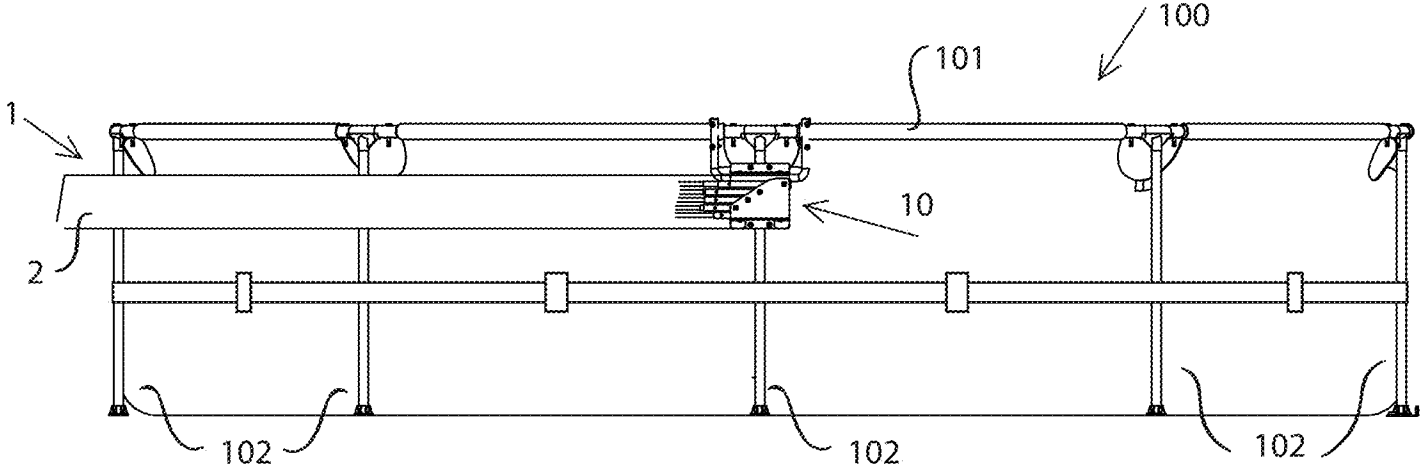
FIG. 1C shows schematically the preferred embodiment of FIG. 1A with the cover in a folded position.
Figure 2A:
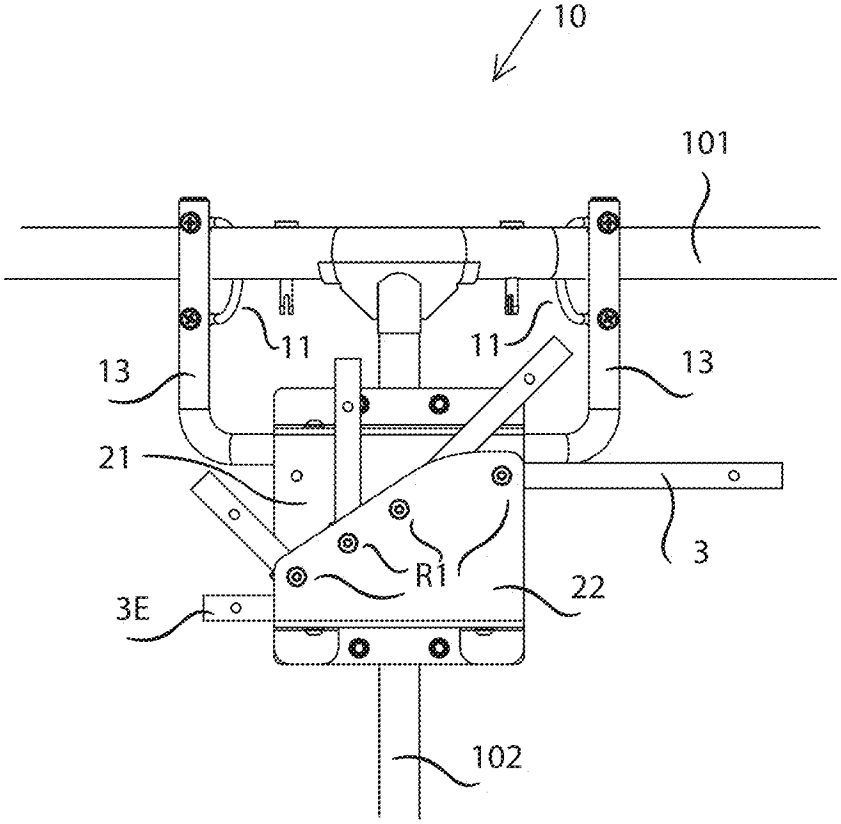
FIG. 2A shows a side view of a support unit as part of the cover in the unfolded position.
Figure 2B:
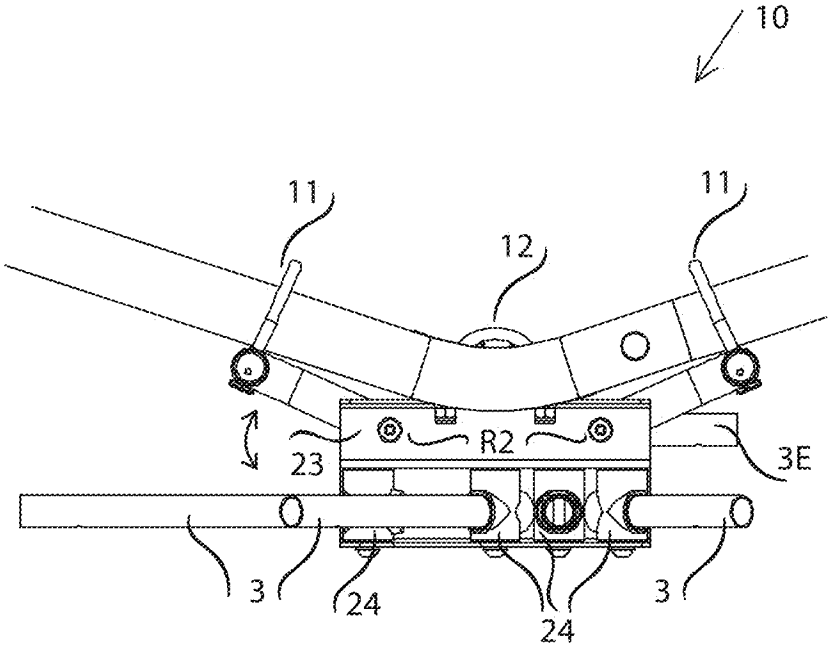
FIG. 2B shows a top view of the support unit of FIG. 2A.

FIG. 1A shows schematically a preferred embodiment of a swimming pool 100 and a foldable cover 1 according to the present invention with the cover in a semi-folded position. FIG. 1B shows the cover 1 in an unfolded position and FIG. 1C shows the cover 1 in a folded position.

The foldable cover 1 comprises a foldable cover material 2 and several supports 3 for folding and unfolding the cover material 2 and two support units 10 to be arranged on opposite sides of the cover for rotatable attachment of outer ends of several supports 3.

According to the invention the cover 1 can be releasably attached to any rail of a swimming pool. In the figures the swimming pool is a frame pool 100 that is typically provided with a top rail 101 and several legs 102 for connection to the top rail 101.

Each support unit 10 has suspension arms 13 that are provided with first suspension means 11 for releasably suspending the support unit 10 on the top rail 101 of the frame pool 100.

The suspension arms 13 are rotatably connected to the support unit 10.

The foldable cover material 2 is tensioned by the supports 3. In the preferred embodiment the cover material 2 is provided with sleeves or pockets (not shown) through which the supports 3 can extend. Preferably the cover material is transparent. Suitable cover materials include PVC and PE.

The supports 3 are preferably made of a flexible material, such as fibre glass, and are herein also referred to as bowed supports, when in the bowed position.

The outer ends of several bowed supports 3 are attachable to rotation shafts 24 that are present in the support unit 10 to allow rotation of said bowed supports 3 with the cover material 2 around first rotation axes R1.

One of the bowed supports 3 is to be attached fixedly at its outer ends to the support units 10 and forms an end support 3E. The end support 3E defines the position of rest of the other bowed supports 3 in the folded position of the cover 1 shown in FIG. 1C.

The suspension arms 13 are rotatably attached to the support unit 10 around second rotation axes R2 that are oriented substantially transverse to the first rotation axes R1. In the preferred embodiment the first suspension means comprise clamps 11, preferably U-shaped clamps.

The support unit 10 is further provided with second suspension means 12 for releasably attaching the support unit 10 on one of the legs 102 of the frame pool 100. In the preferred embodiment the second suspension means comprise clamps 12, preferably U-shaped clamps.

In the preferred embodiment each support unit 10 comprises a housing 20 comprising a first surface 21 and a second surface 22 that are spaced apart. The first rotation shafts 24 extend transverse through both the first and the second surface.

The first surface 21 is at an upper edge connected to a third surface 23 that is oriented substantially transverse to the first surface 21. In the preferred embodiment the suspension arms 13 are connected to the third surface 23, preferably by means of shafts (not shown) through which the second rotation axes R2 extend.

In the preferred embodiment shown the frame pool 100 has a generally round shape and the bowed supports 3 form arches and the cover 1 is generally dome shaped.

The invention is of course not limited to the described and shown preferred embodiment. As an example the cover may have a non-circular shape. Consequently, the invention extends to any embodiment falling within the scope of protection as defined in the claims and as seen in the light of the foregoing description and accompanying drawings.

The invention claimed is:

1. A foldable cover for a swimming pool, wherein the cover comprises a foldable cover material, a number of supports extending over the cover material for folding and unfolding the cover material and two support units to be arranged on opposite sides of the cover for rotatable attachment of outer ends of a number of the supports around first rotation axes, wherein the support units comprise attaching means for attaching the support units to the swimming pool, characterized in that the attaching means comprise suspension arms, which suspension arms are provided with first suspension means for releasably suspending the support unit on a rail of the swimming pool.

2. The foldable cover according to claim 1, wherein the suspension arms are rotatably connected to the support units.

3. The foldable cover according to claim 2, wherein the suspension arms are rotatably connected to the support units around second rotation axes that are oriented substantially transverse to the first rotation axes.

4. The foldable cover according to claim 1 wherein the first suspension means comprise clamps, preferably U-shaped clamps.

5. The foldable cover according to claim 1, wherein each support unit is further provided with second suspension means for releasably attaching the support unit on a leg of a swimming pool.

6. The foldable cover according to claim 5, wherein the second suspension means for releasably attaching the support unit on one of the legs of a swimming pool comprise clamps, preferably U-shaped clamps.

7. The foldable cover according to claim 1, wherein one of the supports is to be attached fixedly at its outer ends to the support units and forms an end support.

8. The foldable cover according to claim 1, wherein each support unit comprises a housing provided with a first and a second surface that are spaced apart, wherein the first rotation axes extend transverse through both the first and the second surface.

9. The foldable cover according to claim 8, wherein a third surface is connected to an upper edge of the first surface and is oriented substantially transverse to the first surface, wherein the suspension arms are connected to the third surface.

10. The foldable cover according to claim 1, wherein the cover is generally dome shaped.

11. The foldable cover according to claim 10, wherein the supports are made of a flexible material and can be bowed to form arches.

12. The foldable cover according to claim 11, wherein the flexible material is fibre glass.

13. The foldable cover according to claim 1, wherein the cover material comprises PVC or PE.

14. The foldable cover according to claim 1, wherein the cover material is transparent.

15. An assembly of a foldable cover according to claim 1, and a frame pool, said frame pool comprising a top rail and a number of legs for connection to the top rail.

* * * * *